US007275971B2

(12) United States Patent
Fujiwara et al.

(10) Patent No.: US 7,275,971 B2
(45) Date of Patent: Oct. 2, 2007

(54) ARC TUBE, DISCHARGE LAMP, AND PRODUCTION METHOD OF SUCH ARC TUBE, WHICH ENABLES BRIGHTER ILLUMINANCE

(75) Inventors: Kenji Fujiwara, Himeji (JP); Toyokazu Amano, Nagaokakyo (JP); Shiro Iida, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 137 days.

(21) Appl. No.: 11/202,350

(22) Filed: Aug. 11, 2005

(65) Prior Publication Data

US 2006/0030232 A1 Feb. 9, 2006

Related U.S. Application Data

(62) Division of application No. 10/712,931, filed on Nov. 13, 2003, now Pat. No. 7,053,555.

(30) Foreign Application Priority Data

Nov. 21, 2002 (JP) ..... 2002-338419

(51) Int. Cl.
*H01J 9/26* (2006.01)

(52) U.S. Cl. ..... 445/22; 445/26

(58) Field of Classification Search ..... 445/22, 445/26

See application file for complete search history.

(56) References Cited

U.S. PATENT DOCUMENTS

| | | | | |
|---|---|---|---|---|
| 5,680,005 | A | 10/1997 | Soules et al. | |
| 5,731,659 | A | 3/1998 | Soules et al. | |
| 5,944,572 | A | 8/1999 | Soules et al. | |
| 7,059,929 | B2 * | 6/2006 | Iida et al. | 445/26 |

FOREIGN PATENT DOCUMENTS

| | | |
|---|---|---|
| CN | 1170107 A | 1/1998 |
| JP | S54-173584 | 5/1978 |
| JP | 61-082634 | 4/1986 |
| JP | 08-339780 | 12/1996 |
| JP | 8-339781 | 12/1996 |
| JP | 08-105087 | 11/1997 |
| JP | 09-293484 | 11/1997 |

* cited by examiner

*Primary Examiner*—Vip Patel

(57) ABSTRACT

Disclosed is a compact self-ballasted fluorescent lamp that includes a phosphor coating provided inside a glass tube bent to have a double-spiral configuration. The arc tube has two spiral parts that are wound around an axis "A", and a turning part joining the two spiral parts. At any cross section of the glass tube, the applied phosphor coating is thicker in the inner surface of the glass tube near the ends of the glass tube in the axis "A" direction, than in the inner surface near the turning part.

17 Claims, 9 Drawing Sheets

FIG.5

(UNIT:mg/cm$^2$)

| POSITION / n | TOP-PART SIDE (Pna) | BASE-PART SIDE (Pnb) |
|---|---|---|
| 1 | 6.6 | 9.1 |
| 2 | 6.7 | 11.1 |
| 3 | 5.8 | 13.2 |
| 4 | 4.6 | 19.2 |

FIG.7

| | UNEVEN-PHOSPHOR LAMP | EVEN-PHOSPHOR LAMP |
|---|---|---|
| LUMINOUS FLUX (lm) | 818 | 785 |
| POWER CONSUMPTION(W) | 12.1 | 12.1 |
| LAMP EFFICIENCY(lm/W) | 67.6 | 64.9 |
| DOWNWARD ILLUMINANCE(cd) | 64 | 58 |

ARC TUBE, DISCHARGE LAMP, AND PRODUCTION METHOD OF SUCH ARC TUBE, WHICH ENABLES BRIGHTER ILLUMINANCE

CROSS-REFERENCE TO RELATED APPLICATIONS

This application is a divisional application of U.S. Ser. No. 10/712,931 filed on Nov. 13, 2003 now U.S. Pat. No. 7,053,555.

This application is based on application No. 2002-338419 filed in Japan, the contents of which are hereby incorporated by reference.

BACKGROUND OF THE INVENTION (1) Field of the Invention

The present invention relates to an arc tube that has spiral parts wound around an axis, a discharge lamp equipped with the arc tube, and a production method of the arc tube.

(2) Related Art

In the present energy-saving era, discharge lamps, exhibiting high luminous efficiency and long life, are calling attentions as light sources alternative to incandescent lamps. The representatives of such discharge lamps are compact self-ballasted fluorescent lamp and fluorescent lamp. The compact self-ballasted fluorescent lamp (hereinafter simply called "lamp") and the fluorescent lamp have a glass tube, as their component, whose inner surface is provided with a phosphor coating.

The phosphor coating is excited in response to irradiation of ultraviolet lights, thereby emitting visible light towards outside of the glass tube in the thickness direction of the phosphor coating. However, the same amount of visible light as that emitted outside the glass tube is also irradiated towards inside of the glass tube. This visible light emitted towards inside of the glass tube is, in turn, partly absorbed by the phosphor coating situating at the opposing side in a cross section of the glass tube. The remainder of the visible light unabsorbed is irradiated towards outside of the glass tube.

The amount of visible light irradiated towards inside of the glass tube increases as the thickness of the phosphor coating increases, and taking advantage of this feature, discharge lamps have been developed that enable the illuminance in the illumination direction to improve (e.g. Japanese Laid-open Patent Application H8-339781).

In the discharge lamp in this prior art, a glass tube constituting the arc tube has a turning part at the substantial center between the two ends of the glass tube, and is wound around an axis from this turning part to the ends, so as to form a double-spiral configuration. In addition, the phosphor coating provided on the inner surface of this glass tube is thicker near the inner side of the spiral configuration (i.e. near the axis), and thinner near the outer side of the spiral configuration. To be more specific, at a cross section of the glass tube, suppose taking two areas of the inner surface of the glass tube, that face each other in a direction that passes through the center of the glass tube and that is substantially orthogonal to the axis. Then, the phosphor coating is thicker in the area which is nearer the axis, than in the other area which is farther from the axis.

Therefore, the amount of the visible light emitted from the entire arc tube in orthogonal and opposite direction to the axis is a summation of: visible light emitted from the area farther from the axis; and visible light emitted from the area nearer the axis. As a result, the illuminance in the orthogonal direction will improve, compared to the illuminance in the other directions.

In the conventional arc tube, at a cross section of the glass tube, the thickness of its phosphor coating is more nearer the axis, and less farther from the axis. Accordingly, it is inevitable that large illuminance is obtained in orthogonal direction to the axis.

Normally, the arc tube of a lamp is used under a state mounted to a lighting device set to the ceiling in advance. In such a case, the turning part will be directed downward. Therefore, there is a problem relating to conventional arc tubes, that compared to the enhanced illuminance in the lateral direction of the arc tube, the downward direction thereof in which illuminance is required will not be illuminated so much.

SUMMARY OF THE INVENTION

In light of the aforementioned problems, the object of the present invention is to provide an arc tube, a discharge lamp, and a production method for the arc tube, that enable downward illumination to improve by efficient use of the visible light emitted from the phosphor coating by means of ultraviolet light excitation.

In order to achieve this object, the arc tube relating to the present invention is an arc tube including: a glass tube having a turning part, and being wound around an axis from the turning part to at least one end of the glass tube, so as to form a spiral part; and a phosphor coating provided on an inner surface of the glass tube, where at any cross section of the glass tube of the spiral part, the phosphor coating is thicker in a first area than in a second area, the first and second areas facing each other in a direction that is parallel to the axis and that passes through a center of the cross section, the first area being nearer the end of the glass tube than the second area is.

With the stated structure, when for example the arc tube is lit, with its turning part directed downward in a state that the axis substantially coincides with the vertical direction, the visible light emitted from the second area will be added to the visible light emitted from the first area towards the turning part. According to this, improved luminance is obtained outside of the turning-part in the axis direction of the arc tube. Therefore, if for example the axis direction is made to coincide with the vertical direction, illuminance is improved in the downward direction of the arc tube.

In addition, the phosphor coating provided on the first area increases in thickness from the turning part towards the glass-tube end. With this construction, the illuminance in the downward direction of the arc tube is improved.

Furthermore, the glass tube is wound around the axis from the turning part to both ends of the glass tube.

Moreover, a mass per unit area of the phosphor coating provided on the second area is in a range of 2 $mg/cm^2$ to 12 $mg/cm^2$ inclusive. In addition, a mass per unit area of the phosphor coating provided on the first area is in a range of 5 $mg/cm^2$ to 30 $mg/cm^2$ inclusive.

With these constructions, more visible light will be obtained from the phosphor coating in the second area. Therefore, if the arc tube is lit with the turning part directed downward, both of the illuminance in the downward direction of the arc tube, and the luminous flux from the arc tube will be enhanced.

Also, the phosphor coating is a three band phosphor coating.

The discharge lamp relating to the present invention is equipped with the arc tube having the aforementioned structure.

In addition, the method of producing the arc tube of the present invention is a method of producing an arc tube including: a glass tube having a turning part, and being wound around an axis from the turning part to at least one end of the glass tube, so as to form a spiral part; and a phosphor coating provided on an inner surface of the glass tube, the production method including: a step of forming the turning part and the spiral part, by bending a glass tube; a step of injecting a phosphor-including suspension into the glass tube bent at the forming step; a step of allowing the suspension to flow from inside the glass tube after the injection step, by keeping the glass tube in an upright state, with the turning part positioned on top; and a step of drying the glass tube after the flow-allowing step, in the upright state.

With this construction, such an arc tube is easily obtained, that has a structure in that at any cross section of the glass tube of the spiral part, the phosphor coating is thicker in a first area than in a second area, the first and second areas facing each other in a direction that is parallel to the axis and that passes through a center of the cross section, the first area being nearer the end of the glass tube than the second area is.

In the present invention, in particular, the glass tube is wound around the axis from the turning part to both ends of the glass tube.

In addition, the suspension is injected into the glass tube with the turning part positioned on top. Further, the injection of the suspension continues until the injected suspension exceeds the turning part. With these constructions, during an operation of allowing the suspension having been injected such as into a double-spiral glass tube, to flow from inside, the suspension will not yield foam. Moreover, drying is performed with the glass tube in its initial position.

In addition, a viscosity of the suspension is in a range of 4.5 cP to 8.0 cP inclusive. With this construction, the applied phosphor coating will be thicker in the opposite side to the turning-part side (i.e. in the first area) than in the turning-part side (i.e. in the second area) at a cross section of the glass tube.

Furthermore, an inner diameter of the glass tube is in a range of 5 mm to 9 mm inclusive. For such an arc tube having small inner diameter, the present invention enables the phosphor coating to be uneven, in the axis direction at a cross section of the glass tube.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings:

FIG. 5 is a table showing the number of turns from the top part, and the mass per unit area of the phosphor coatings respectively applied on the end-part side inner surface and the top-part side inner surface, at each measurement position specified by the number of turns, in the cross sectional view of the glass tube constituting the arc tube;

FIG. 7 is a table showing the measurement result of the luminous flux and the downward illuminance which is measured directly below the lamp, after 100 hours of aging;

DESCRIPTION OF THE PREFERRED EMBODIMENTS

The following describes an embodiment in which the present invention is applied to a compact self-ballasted fluorescent lamp, with reference to the corresponding drawings.

1. The Structure of the Compact Self-Ballasted Fluorescent Lamp

Figure 1:
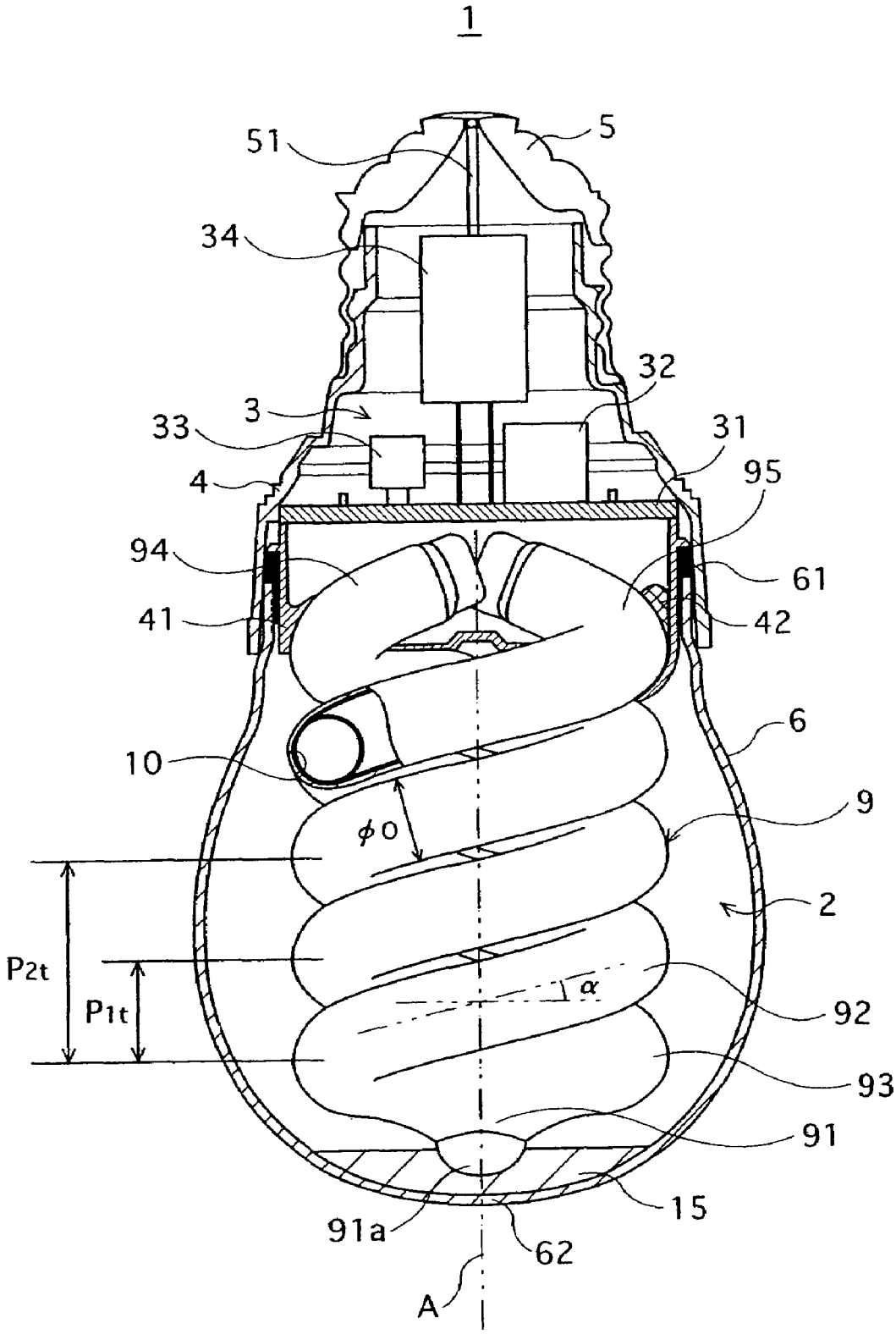
FIG. 1 is a front partly-broken view of the entire structure of the compact self-ballasted fluorescent lamp of the embodiment of the present invention.

FIG. 1 is a diagram showing the front sectional view of the compact self-ballasted fluorescent lamp relating to the present embodiment. This compact self-ballasted fluorescent lamp (hereinafter, simply referred to as "lamp 1") of 12 W is an alternative for an incandescent lamp of 60 W.

As shown in FIG. 1, the lamp 1 is equipped with: an arc tube 2 formed by bending a glass tube into a double-spiral configuration; an electronic ballast 3 for lighting the arc tube 2; a case 4 which stores therein the electronic ballast 3 and also includes a base 5; and an globe 6 for covering the arc tube 2. Note here that the arc tube 2 is held by the holder (supporting member) 41 of the case 4.

Figure 2:
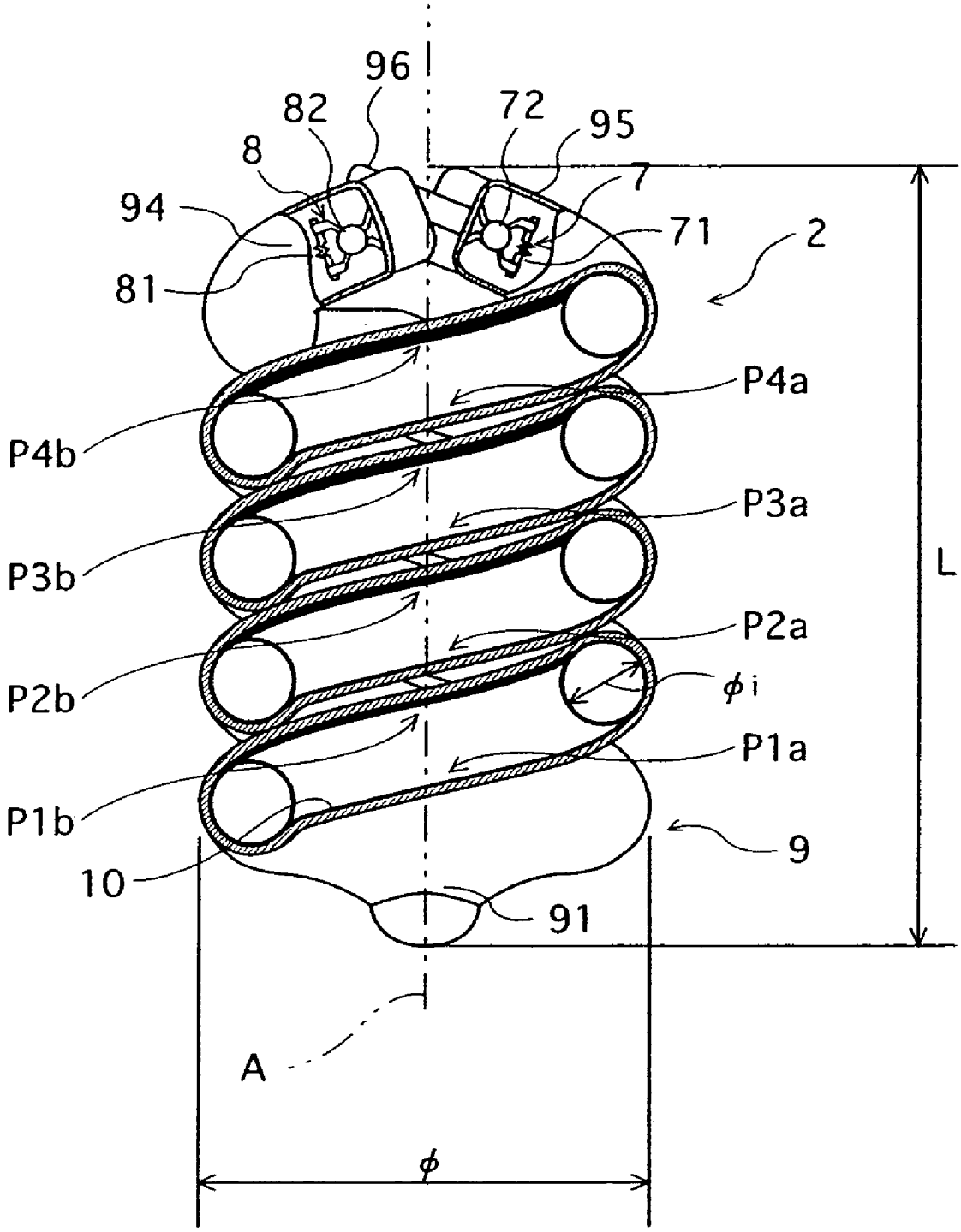
FIG. 2 is a front partly-broken view of the glass tube, which is for explaining the internal appearance of the arc tube.

FIG. 2 is a front partly-broken view of the glass tube, for explaining the inside appearance of the arc tube.

As shown in FIGS. 1 and 2, the arc tube 2 is formed by bending the glass tube 9. Specifically, this glass tube 9 is turned at the turning part 91 in the substantial center of the glass tube 9, and is wound around the axis "A" from this turning part 91 to the both ends. In other words, thus bent glass tube 9 consists of two spiral parts 92 and 93, and a turning part 91 that connects these two spiral parts 92 and 93 at the top (i.e. corresponding to the bottom end of the arc tube in FIG. 1).

Here, the glass tube 9 that constitutes the arc tube 2 has an inner diameter $\phi i$ which is substantially 7.4 mm, and an outer diameter $\phi o$ which is substantially 9.0 mm. Both of the two spiral parts 92 and 93 are wound around the axis "A" for about 4.5 times. Hereinafter in this specification, number of turns from the turning part 91 as a starting point, is occasionally used to explain the glass tube at the spiral parts 92 and 93.

Note that the inner diameter $\phi i$ of the glass tube 9 is preferably in the range between 5 mm and 9 mm inclusive. This is because it becomes difficult, with the inner diameter $\phi i$ being smaller than 5 mm, to set the electrode mentioned later inside the glass tube 9, and that, with the inner diameter ϕi being grater than 9 mm, the arc tube 2 will be greater in size than the conventional incandescent lamp of 60 W.

The pitch $P_{2t}$ between two adjacent glass tubes belonging to one spiral part, throughout the turning part 91 to the end of the spiral part, is 20 mm. The pitch $P_{1t}$ between any two parts of the glass tube that are adjacent to each other in the direction parallel to the axis "A" is 10 mm (hereinafter, this direction parallel to the axis "A" is simply referred to as "axis direction"). This means that the distance between two parts of the glass tube that are adjacent to one another, in the axis direction, is approximately 1 mm. This distance is preferably 3 mm or smaller. This is because, with this distance being greater than 3 mm, the length of the arc tube 2 will be too long, and also has a greater chance of yielding luminance irregularities caused by too much distance between the neighboring glass tubes. In addition, the spiral parts 92 and 93 are wound around the axis "A", having an angle of inclination 14.5 degrees with respect to the orthogonal direction to the axis "A" (this angle of inclination is shown as 60 in FIG. 1).

The length "L" of the arc tube 2 in the double-spiral configuration is approximately 65 mm (i.e. size of the arc tube 2 from its turning part to the end nearer the electrode sealing part), and has the maximum outer diameter ϕ which is approximately 36.5 mm. It is preferable that the maximum outer diameter ϕ of the arc tube 2 is in the range between 30 mm and 40 mm inclusive. If this maximum outer diameter ϕ being within the stated range, the arc tube 2 can be fit into the globe of A-type, which is the same bulb-type as used for the conventional incandescent lamp.

Note here that the following terminology will be occasionally used in this specification. That is, in the axis direction of FIG. 2, the downward side is occasionally referred to as "top-part side" because the top part of the arc tube 2 (i.e. where there is the turning part 91 of the glass tube 9) positions in that direction. Conversely, the upward side is occasionally referred to as "base-part side" because the arc tube is supported by the holder 41 at the base part (i.e. where there are the ends 94 and 95 of the glass tube 9) positioning in this direction.

In the respective ends 94 and 95 of the glass tube 9, electrodes 7 and 8 are sealed. For the respective electrodes 7 and 8, coil electrodes 71 and 81 made of tungsten are used for example. The coil electrodes 71 and 81 are supported by a pair of leadwire (not shown in the drawing) which is tentatively fixed by means of beads glass 72 and 82 (with a so-called beads glass mounting method) as shown in FIG. 2. Note that a soft glass such as strontium-barium silicate glass may be used for the glass tube 9.

To one end of the glass tube 9 (the reference number 95 in this example), an exhaust tube for evacuating the inside of the glass tube 9 is fixed at the time of mounting of the electrode 7. Note that the distance between electrodes 7 and 8, within the arc tube 2 is about 400 mm.

The inner surface of the glass tube 9 is provided with a rare-earth phosphor coating 10, whose application method is detailed later. This phosphor coating 10 contains three kinds of phosphors respectively emitting light of red, green, and blue (i.e. for three-band purpose).

The following can be said for the thickness of this phosphor coating 10. That is, at any cross section of the glass tube 9 that constitutes each turn of the spiral parts 92 and 93, suppose taking two inner-surface areas facing each other in the axis direction that passes through the center of the cross section of the glass tube 9. Then, the phosphor coating is thicker in one of the areas that positions nearer the base part, than in the other area nearer the top part (hereinafter in the present invention, the one area nearer the base part is occasionally referred to as "first area", and the other area nearer the top part is occasionally called "second area").

Further, at the cross section of the glass tube 9, the phosphor coating provided on the area nearer the base part increases in thickness from the turning part 91 towards the ends 94 and 95.

Conversely, the phosphor coating provided on the other area nearer the top part stays substantially the same, from the turning part 91 towards the ends 94 and 95, or gets gradually thinner. The concrete thickness information will be given later.

Inside the glass tube 9, about 5 mg of mercury in a single form is enclosed. Also enclosed therein is a buffer gas such as argon gas, through the aforementioned exhaust tube 96, at 600 Pa.

As shown in FIG. 1, the described arc tube 2 has a structure in which the ends 94 and 95 of the glass tube 9 are inserted into the holder (supporting member) 41, and are fixed to the holder 41 by means of an adhesive 42 such as silicone, and the like. The rear side of the holder 41 (i.e. side of the base 5) is provided with a substrate 31 to which a plurality of electric parts 32, 33, and 34 are fixed, for lighting the arc tube 2. Note that these electric parts 32, 33, and 34 constitute the electronic ballast 3 operated in a so-called series inverter method. The circuit efficiency thereof is 91%.

The case 4 is made of synthetic resin, and has a tube shape widening in the downward direction, as shown in FIG. 1. The holder 41 to which the arc tube 2 and the substrate 31 are mounted is inserted to the case 4, so that the electronic ballast 3 situates at the back. Then, the outer surface of the rim of the holder 41 is provided with an adhesive 61 to be attached to the inner surface of the rim of the case 4. At the top direction of the case 4 (i.e. opposite direction to where the opening part positions), the base 5 for E26 is mounted. Note that the base 5 and the substrate 31 are electrically conducted to each other via the lead wire 51.

The globe 6 is for covering the arc tube 2 and its opening part is inserted inside the opening part of the case 4 and fixed thereto, in a manner that the outer surface of the end of the opening part of the globe 6 is attached to the inner surface of the end of the opening part of the case 4 by means of the adhesive 61. Note here that the lamp 1 (globe 6) has a maximum outer diameter of about 55 mm, and a length of about 110 mm. Just for reference purpose, the size of the incandescent lamp of 60 W is a maximum outer diameter of about 60 mm, and a length of about 110 mm.

The globe 6 is made of glass material having excellent decorative characteristics, and is shaped like an eggplant (i.e. so-called A-shape). The inner surface of the globe 6 is provided with a diffusion coating (not shown in the drawing). One example of material for this diffusion coating is a powdery substance whose main component is calcium carbonate.

At the lower end of the arc tube 2 (i.e. at the turning part 91), a convex part 91*a* is formed that bulges out in the downward direction (i.e. opposite side to the base 5 in the axis direction). This convex part 91*a* and the lower end of the inner surface of the globe 6 (lower-end part 62) are thermally connected to each other by means of thermal conductivity medium 15 made of transparent silicone. Note that the lower end of the arc tube 2 is, in other words, a tip of the glass tube 9 closer to the turning part 91.

2. The Production Method of the Arc Tube

Figure 3C:
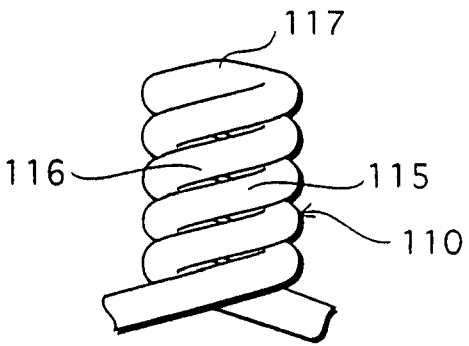
FIGS. 3A, 3B, and 3C each are a diagram for explaining processes of forming the double-spiral configuration, by bending the glass tube.
Figure 3B:
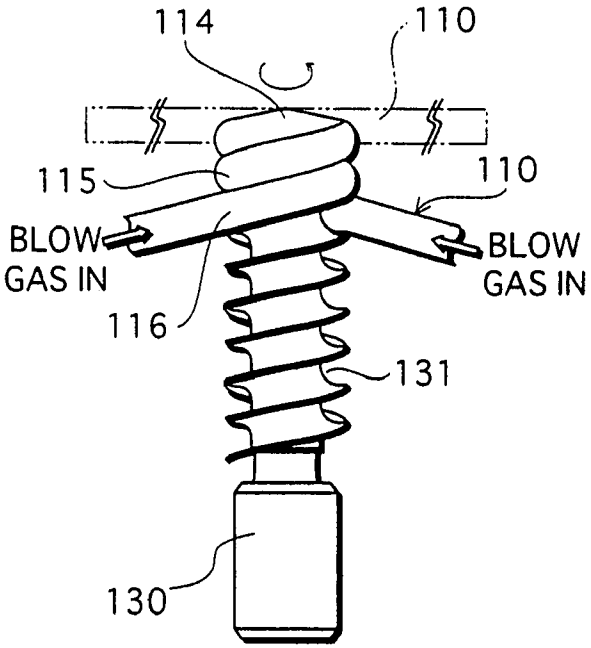
Figure 3A:
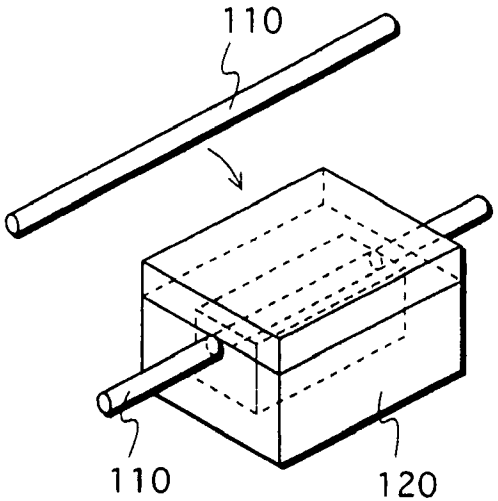

The method of producing the arc tube 2 is detailed as follows. FIGS. 3A, 3B, and 3C each are a diagram explaining the process in which the glass tube is bent for shaping, and FIGS. 4A, 4B, and 4C each are a diagram explaining the process in which a phosphor coating is applied. Note that the following description only talks about the processes of forming a straight glass tube as a double-spiral configuration, and of forming a phosphor coating in thus formed glass tube. Accordingly, the following description does not talk about such as enclosing in the glass tube, a buffer gas and mercury, and sealing therein electrodes that are performed thereafter, since they are the same processes as performed in the conventional method.

1) Forming the Arc Tube

A) Process of Softening a Glass Tube

First, a straight glass tube 110 such as shown in FIG. 3A is prepared. This glass tube 110 has a substantially round cross section, and inner diameter of the tube $\phi i$ of about 7.4 mm, and has an outer diameter $\phi o$ of about 9.0 mm. As shown in FIG. 3A, the middle part of this straight glass tube 110, including at least the part of the glass tube 110 to be formed in a double-spiral configuration, is set into the heating furnace 120 that uses such as electricity and gas, then the glass tube 110 is heated so that the temperature thereof reaches at least the softening point, thereby softening the middle part of the glass tube 110.

B) Process of Winding the Glass Tube

The softened glass tube 110 is taken out from the heating furnace 120, then as shown in FIG. 3B, the substantial center 114 of the glass tube 110 is set to the top part of a mandrel 130 (made of stainless), then this mandrel 130 is rotated using a driving apparatus unshown in the drawing.

By doing so, the softened glass tube 110 will be wound around the mandrel 130, with the substantial center 114 being the turning part 117, and two spiral parts that go around the spiral groove 131 created on the outer surface of the mandrel 130 being the respective spiral parts 115 and 116.

During the operation of winding the glass tube 110 around the mandrel 130, a gas such as pressure-controlled nitrogen is blown into the glass tube 110 at 0.4 kg/cm$^2$, to retain a cross sectional shape of the glass tube 110 substantially circular.

Once the temperature of the softened glass tube 110 falls, and the glass tube 110 returns to a hard state, the mandrel 130 is rotated in the direction opposite to the direction in which the glass tube 110 is wound, so as to remove the glass tube 110 formed in double-spiral configuration, from the mandrel 130.

The glass tube 110 removed from the mandrel 130 is then cut as predetermined. Hereinafter, thus cut double-spiral glass tube is assigned reference number of "100", so as to distinguish it from the straight glass tube, or from the glass tube under winding process.

2) Application of Phosphor Coating

A) Injection Process

Figure 4A:
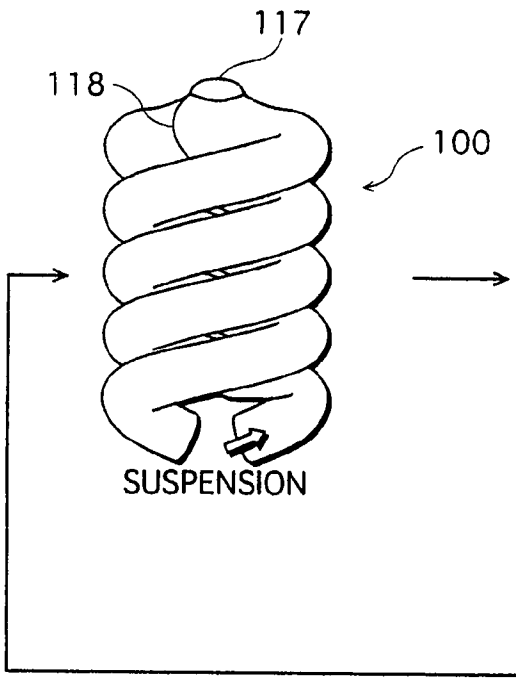
FIGS. 4A, 4B, and 4C each are a diagram for explaining processes of applying a phosphor coating inside the glass tube formed in the double-spiral configuration.
Figure 4B:
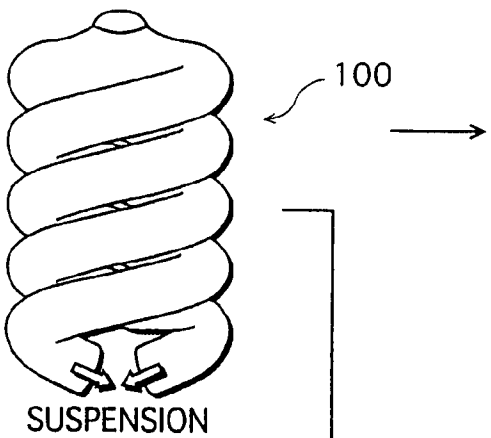
Figure 4C:
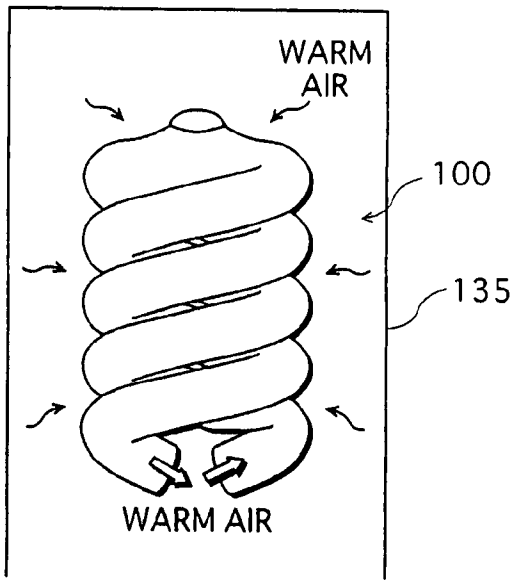

The following describes the method of providing a phosphor coating on the inner surface of thus produced glass tube 100 to be used as an arc tube, with use of FIGS. 4A, 4B, and 4C.

First, a phosphor 12 to be used is for three-band purpose, and is composed of three kinds of phosphors that emit light of red, green, and blue. A suspension including this phosphor 12 is prepared. The three types of phosphors used here are respectively: europium-inactivated yttrium oxide ($Y_2O_3$:$Eu^{3+}$) for red, cerium.terbium-inactivated lanthanum phosphate ($LaPO_4$:$Ce^{3+}$, $Tb^{3+}$) for green, and europium-inactivated barium magnesium aluminate ($BaMg_2Al_{10}O_{17}$:$Eu^{2+}$) for blue.

The prepared suspension includes, other than the phosphor 12, a binder, an adhesive agent, a surface-active agent, and a deionized water. The binder improves viscosity of the suspension, and polyethylene oxide is used therefor as an example. The adhesive agent attaches the phosphor to the glass tube 100, and oxide material mixture between lanthanum and aluminum is used therefor as an example. Note that the viscosity of the suspension used here is 5.8 cP.

Next, as shown in FIG. 4A, the double-spiral glass tube 100 is set in an upright position with its turning part 117 positioned on top. Then, the suspension is injected from one end of the glass tube 100. The suspension is injected with use of an injection nozzle (not shown in the drawing) for example. The injected suspension will go up inside the glass tube bent in double-spiral configuration. Note that the amount of suspension to be injected in a unit time is 7-10 l/min.

When the tip of the suspension going up inside of the glass tube 100 toward the turning part 117 (reference number "118" in FIG. 4A) exceeds the center of the glass tube 100 (i.e. exceeds the turning part 117), the injection of the suspension is stopped, and the suspension inside the glass tube 100 is allowed to flow from the both ends of the glass tube 100, keeping the position of glass tube 100 as it is.

After ending of the flow-allowing process, the other end of the glass tube 100 is in turn used to inject the suspension into the double-spiral glass tube 100. In this operation too, the injection of suspension continues till the tip of the suspension exceeds the turning part 117, and thereafter, the suspension in the glass tube 100 is allowed to flow from inside, keeping the position of the glass tube 100 as it is.

B) Drying Process

After ending of the flow-allowing process for the glass tube 100, the glass tube 100 is set into the drying furnace 135 in the same upright position as in the prior process, to let it dry, as shown in FIG. 4C. During this operation, a warm air is blown inside from the both ends of the glass tube 100 alternately, so as to fasten the drying process. The temperature inside the drying furnace 135 is kept to be about 45° C., where the glass tube 100 is set for about 8 minutes.

In addition, the blowing of the warm air is conducted using a warm-air nozzle at 6 l/min. The temperature of the warm air is about 45° C. With completion of the process of drying the suspension applied on the inner surface of the glass tube, the entire application processes of the phosphor coating end.

Compared to the aforementioned method, the conventional production method for arc tubes in a double-spiral configuration is for example as follows. In a straight glass tube, a phosphor coating is applied first in a down flash method. Then, the glass tube is heated to be bent in double-spiral configuration. If the radius of the turn resulting from the glass tube being wound around an axis is large enough (hereinafter, this radius is called "spiral radius"), this conventional method hardly exhibits problems such as cracking and falling-off of the phosphor coating applied on the inner surface of the glass tube. However, if the spiral radius is small such as in this embodiment, the mentioned problems of cracking and falling off of the phosphor coating will happen, obstructing production of the glass tube that has a phosphor coating inside. This means that the stated conventional method is not for use for arc tubes having small outer diameter, such as described in the present embodiment.

On the contrary, with the production method for the arc tube in the present embodiment, the glass tube 110 is first bent to have double-spiral configuration. Therefore, after the glass tube 110 is wound around the mandrel 130, it is then easy to provide a phosphor coating therein, despite the small outer diameter of the arc tube.

3. Lamp Quality

1) Thickness of the Phosphor Coating (in Mass Per Unit Area)

The thickness of the phosphor coating of the arc tube produced in the above production method is measured. The measurement position is determined as follows. First, as shown in FIG. 2, suppose cutting the arc tube 2, at a plane including the axis "A" in an orthogonal direction to the paper on which the drawing is drawn. Then, the measurement positions are identified as positions at the cross section of the glass tube at each turn, the positions facing each other in the axis direction that passes through the center of the cross section of the glass tube. Note that "n" in the reference signs Pna, Pnb that represent measurement positions signifies number of turns from the turning part 91. "a" signifies that, at one cross section of the glass tube 9, it is one of the two measurement positions that is nearer the top part in the axis direction (top-part side); and "b" signifies that it is a measurement position nearer the base part in the axis direction at the cross section of the glass tube 9 (base-part side) (i.e. farther from the turning part in the axis direction).

Figure 6:
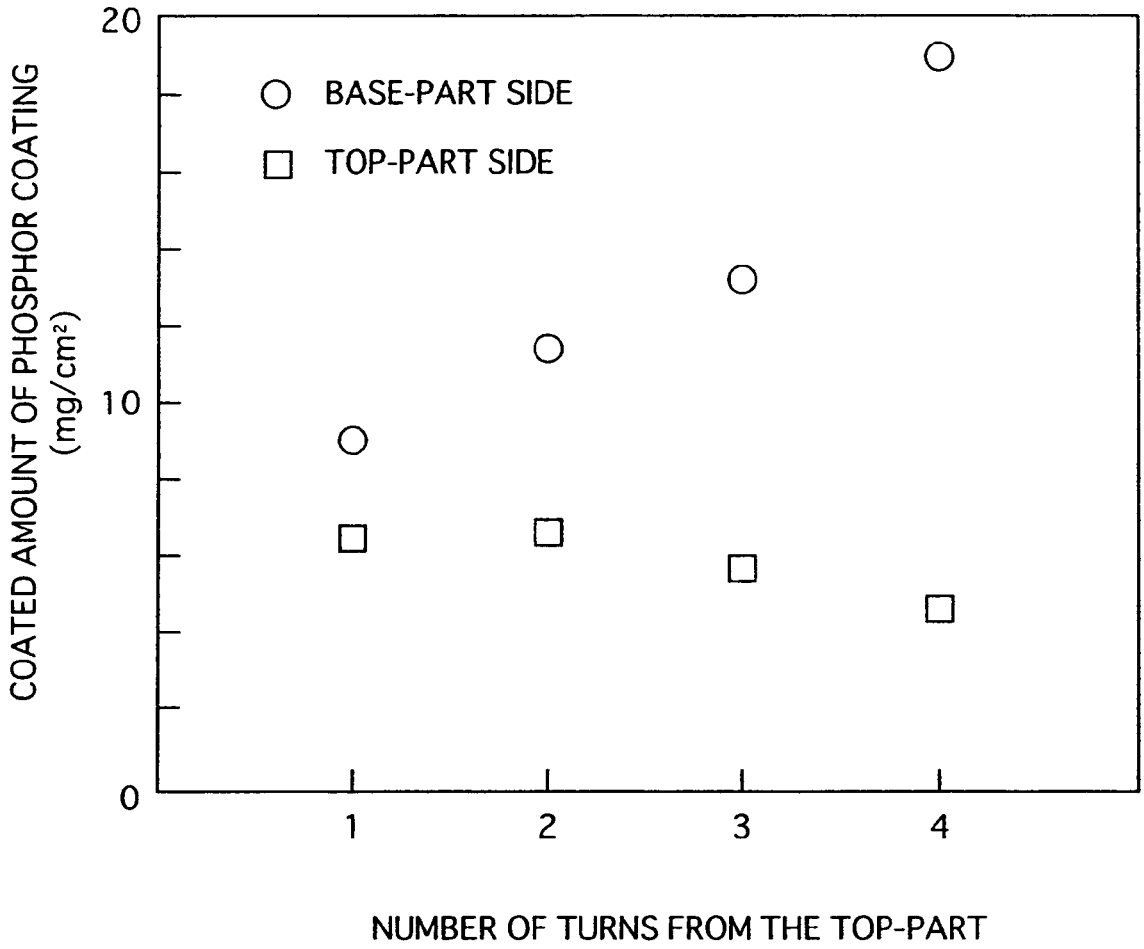
FIG. 6 is a diagram showing the relationship between the number of turns from the top part, and the mass per unit area of the phosphor coatings respectively applied on the end-part side inner surface and the top-part side inner surface, at each measurement position specified by the number of turns, in the cross sectional view of the glass tube constituting the arc tube.

The following FIG. 5 and FIG. 6 show the measurement results of the thickness of the phosphor coating at each measurement position. Note that the content of measurement shown regarding coating-thickness is actually a measurement result of a mass of the phosphor coating per unit area at each measurement position, and not a measurement result of the actual coated thickness for each measurement position.

The mass of the phosphor coating per unit area at each measurement position (hereinafter also called "coated amount of the phosphor coating") is, as shown in the mentioned diagrams, greater at the base-part side than at the top-part side in the cross sectional view of glass tube at each turn. This means that, in each cross section of the glass tube, the phosphor coating provided to the base-part side in the axis direction is thicker than that provided to the top-part side.

Furthermore, the coated amount of the phosphor coating at the base-part side (i.e. the measurement positions P1*b*, P2*b*, P3*b*, and P4*b*, in FIG. 2) increases, as the number of turns increases (i.e. from the turning part towards the holder). To put it in the opposite way, at each of the cross sections of the glass tube, the phosphor coating at the base-part side becomes thinner towards the turning part.

Conversely, the coated amount of the phosphor coating at the top-part side (i.e. the measurement positions P1*a*, P2*a*, P3*a*, and P4*a*, in FIG. 2) stays substantially the same, or tends to slightly decrease, even if the number of turns increases.

2) Lamp Quality

As shown in the aforementioned measurement result, if the aforementioned application method is used for applying a phosphor coating to an arc tube, the thickness of the phosphor coating differs in the axis direction. As follows, the following two lamps are lit, and the luminous flux for these lamps is measured. One lamp uses an arc tube whose glass tube is provided with a phosphor coating with different thickness in the axis-of-spiral direction of the glass tube (hereinafter "uneven-phosphor lamp"), and the other lamp uses an arc tube whose glass tube is provided with a phosphor coating of substantially uniform thickness ("even-phosphor lamp").

Note that the thickness of the phosphor coating for the even-phosphor lamp is set to be approximately 5.8 mg/cm$^2$.

The conditions under which the lamp quality measurement was conducted are listed below:

| | |
|---|---|
| Applied voltage | alternate current 100 V (frequency: 60 Hz) |
| Temperature at lighting | 25° C. |
| Lighting orientation | lighting is performed with the base oriented upward |
| Power consumption | 12 W |

The lamps were lit under these conditions, and the lamp quality after 100 hours of aging is measured. The specific lamp qualities measured here are luminous flux at the time of lighting, and so called downward illuminance, which is illuminance directly below each arc tube.

The lamp qualities are shown in FIG. 7. As clear from FIG. 7, the luminous flux is 785 lm for the even-phosphor lamp, and 818 lm for the uneven-phosphor lamp, meaning that the uneven-phosphor lamp has about 33 lm improvement (about 4%) in luminous flux. The reason is considered to be as follows. That is, since the uneven-phosphor lamp has thicker phosphor coating at the base-part side compared to at the top-part side, the amount of visible light emitted from the phosphor coating of the base-part side towards the top-part side increases, which adds to the total amount of visible light emitted from the top-part side directly towards outside the arc tube, thereby increasing the entire luminous flux.

According to the increase in this luminous flux, the uneven-phosphor lamp has improved luminous efficiency compared to the even-phosphor lamp, by about 2.7 lm/W (4%). Specifically, the luminous efficiency for the even-phosphor lamp is 64.9 lm/W, whereas the luminous efficiency for the uneven-phosphor lamp is 67.6 lm/W. As these results suggest, the entire light output increases by increasing the thickness of the phosphor coating applied nearer the base part in the axis direction of a cross section of the glass tube.

Figure 8:
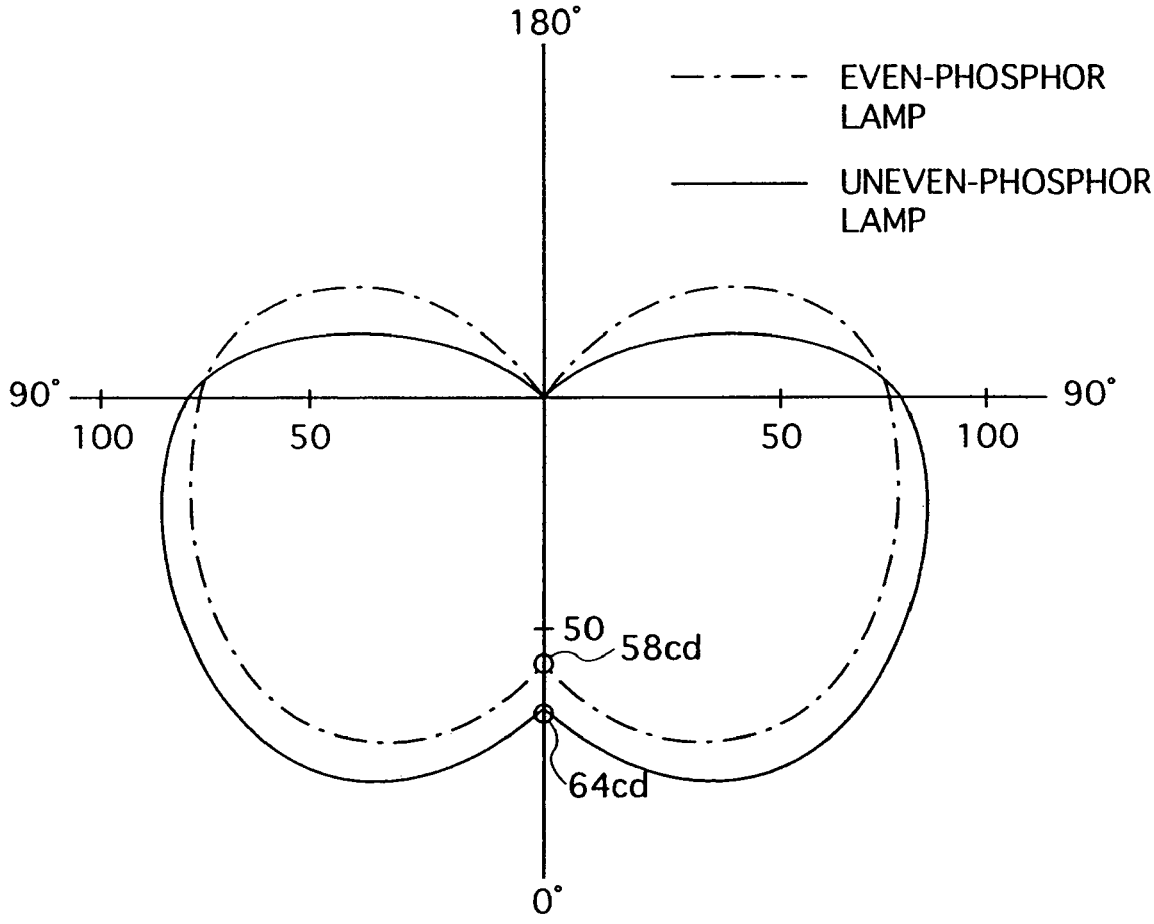
FIG. 8 is a light distribution curve showing the light distribution characteristics for an uneven-phosphor lamp that has an unevenly provided phosphor coating, and an even-phosphor lamp that has an evenly provided phosphor coating.

FIG. 8 shows a light distribution curve showing the light distribution characteristic of the lamps at the time of lighting. As shown in this drawing and in FIG. 7, the downward illuminance measured directly below the lamp was 58 cd for the even-phosphor lamp, whereas for the uneven-phosphor lamp, it was 64 cd, showing about 6 cd improvement (about 10% increase).

The reason for this is considered the same as mentioned for the aforementioned luminous flux improvement. That is, for the uneven-phosphor lamp, the visible light emitted from the phosphor coating of the base-part side towards the top-part side has increased, because of the thickening of the phosphor coating applied on the base-part side in the axis direction in the cross section of the glass tube. In addition, the thicker part of the phosphor coating (hereinafter also referred to as "thick-application part") is arranged to position opposite to the place immediately below the lamp, the place being to which the lamp will directly irradiates light, and so the visible light from the thick-application part will be directly irradiated immediately below the lamp.

MODIFICATION EXAMPLE

So far, the present invention has been described by way of an embodiment. However, needless to say, the contents of the present invention should not be limited to the concrete example shown in the embodiment detailed above, and may include the modification example described below.

1. Globe for Arc Tube

In the above-described embodiment, A-type globe is used to cover the arc tube. However, other shapes of globe may be alternatively used, such as T-type and G-type. Furthermore, the arc tube is attached, at its top, to the globe via a silicone. However, the arc tube may not be attached to the globe. Furthermore, this globe is not always necessary. In such cases too, the same effect can be obtained as in the embodiment described above.

2. Suspension for Phosphor Coating

1) Material

In the above-described embodiment, for application of a phosphor coating on the inner surface of the glass tube, a suspension for three-band purpose is used, that contains red, green, and blue phosphors. However, other kinds of phosphor may be alternatively used, such as a suspension whose main component is calcium halophosphate phosphor, frequently used for general lighting, and it may also add phosphors for emitting red, green, or blue light, to the suspension including calcium halophosphate phosphor.

2) Viscosity of the Suspension

With the suspension of the above-described embodiment, the viscosity of the suspension is controlled to be 5.8 cP, by adjusting the constituting ratio of such as a binder and a deionized water in the suspension production. However, the viscosity may change according to such as the inner diameter of the glass tube, the distance between glass tubes that are adjacent to each other in the axis direction (this distance is called "spiral pitch"), and kinds of phosphor and component therefor.

With the suspension used in the above-described embodiment, if its viscosity is in the range of 4.5 cP to 8.0 cP, and the size and the spiral pitch are as mentioned above, it becomes possible to have thicker phosphor coating applied on the base-part side in the axis direction at any cross section of the glass tube, than on the top-part side. This enables the downward illuminance to improve at the lamp illumination.

Note that in the present embodiment, even if the viscosity of the suspension is not within the range of 4.5 cP to 8.0 cP, it is still possible to have thicker phosphor coating at the base-part side in the axis direction at any cross section of the glass tube, than at the top-part side. However, with such a range of viscosity, it is possible that the luminous flux from the arc tube will decreases, or that the resulting downward illuminance is not so different from the even-phosphor lamp. Therefore, the aforementioned range for the suspension viscosity is necessary for realizing phosphor application that enhances the total luminous flux emitted from the arc tube, and that improves the downward illuminance, compared to a lamp having an arc tube in which phosphor is applied substantially uniform inside the glass tube.

Accordingly, if there is any change regarding such as spiral pitch of the arc tube, size of the glass tube, and kind of phosphor used, it is preferable to determine appropriate viscosity of the suspension by experiments performed under the actual application processes.

3. Thickness of Phosphor Coating

1) Phosphor Coating Applied in the Turning-Part Side

The above-described embodiment has about 5.8 mg/cm$^2$ as the mass per unit area of the phosphor coating applied at the turning-part side in the axis direction at any cross section of the glass tube constituting the arc tube. However, the range of 2 mg/cm$^2$ to 12 mg/cm$^2$ is allowable therefor. The reason is that when the thickness of the phosphor coating is about 5.8 mg/cm$^2$, the luminous flux emitted from the arc tube will be the maximum; and that if the thickness is within the range of 2 mg/cm$^2$ to 12 mg/cm$^2$, the phosphor coating will yield luminous flux not so different from the maximum luminous flux.

2) Phosphor Coating Applied in the End-Part Side

The above-described embodiment has about 13.9 mg/cm$^2$ as the mass per unit area of the phosphor coating applied at the opposite side to the turning-part side (i.e. applied at the end-part side), in the axis direction at any cross section of the glass tube constituting the arc tube. However, the range of 5 mg/cm$^2$ to 30 mg/cm$^2$ is allowable therefor.

Determination of this range is based on an experiment described as follows.

In the above-described embodiment, an arc tube having double-spiral configuration is used. However, the experiment was performed using a straight arc tube, for easy execution.

The used straight tube is a straight-tube fluorescent lamp of 20 W type, which has a diameter of 25 mm and length of 580 mm. This straight glass tube is first provided with a phosphor coating therein substantially uniformly, in the down flash method. The coated amount of the phosphor coating is about 5.8 mg/cm$^2$. The reason for this is for maximizing the luminous flux from the arc tube, as described in the item 1) stated above. Note that the phosphor coating used in the experiment is the same as that used in the aforementioned embodiment. Likewise, the components of the suspension used here is substantially the same.

Next, the glass tube in which the phosphor coating has been applied uniformly is tilted, thereby allowing the suspension to flow from the end of the glass tube that is positioned high. During this operation, the suspension will flow at the bottom-end part at a cross section of the glass tube, resulting in generation of the thick-application part that has thick phosphor coating thereon, over which the suspension has flowed. Note that in a cross section of the glass tube, the part on which the phosphor coating has been applied first and that opposes the thick-application part is called "thin-application part".

In the above way, four types of arc tubes were created, that each have coated amount (mg/cm$^2$) of phosphor at the respective thick-application parts which are 3.5, 8.5, 14.8, and 22.4, by allowing the suspension to flow on the predetermined position for several times after the entire glass tube was coated with phosphor evenly.

For thus created arc tubes, the luminance at the opposing side to the thick-application part (i.e. at the side of the thin-application part) is measured, as well as the luminous flux emitted from the arc tubes. The measurement result is shown in FIG. 9.

Figure 9:
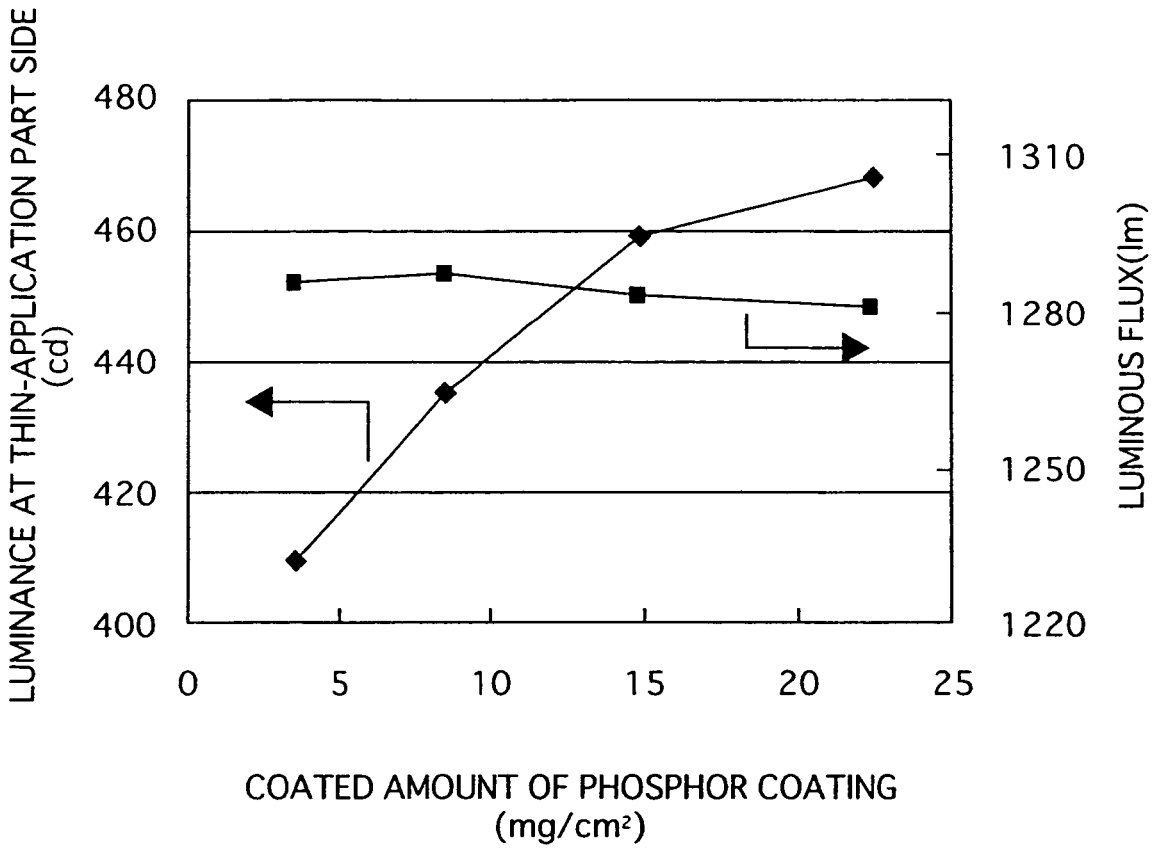
FIG. 9 is a diagram showing, for a straight arc tube, the relationship among the coated amount of phosphor coating, luminance at the thin-application part side and luminous flux.

As seen from FIG. 9, the luminance at the thin-application part increases as the mass per unit area of the phosphor coating increases. On the contrary, the luminous flux from the arc tube can be considered to stay substantially constant, as a whole, although it recorded the maximum when the mass is 8.5 mg/cm$^2$.

As seen from the mentioned results, if, at the thick-application part, the coated amount of the phosphor coating is in a range of 5 mg/cm$^2$ to 30 mg/cm$^2$, it is possible to prevent the large decrease in luminous flux emitted from the arc tube, as well as to enable the luminance to be enhanced at the thin-application part side.

The coated amount of these phosphor coatings are for the straight arc tube. However, since the structure of the phosphor coating used is the same as used in the present embodiment, it is considered to be referred to, for the present embodiment in which the arc tube is in the double-spiral configuration.

4. Shape of Arc Tube

In the above-described embodiment, the arc tube is bent at the turning part, and both sides therefrom are made to wound around an axis, up to the corresponding ends of the glass tube, so as to be formed as a double-spiral configuration on the whole. However, the arc tube may take other shapes, including a shape that the glass tube constituting the arc tube is wound around an axis from its turning part to only one end of the glass tube, so as to be formed as a single spiral configuration. Or that, in the glass tube formed as the same double-spiral configuration which is wound around an axis from the turning part to both ends of the glass tube, these ends of the glass tube may be arranged to run in substantially axis direction. With such shapes of the arc tube, too, the same effect will be obtained as that in the embodiment.

Furthermore, in the above-described embodiment, the spiral configuration of the arc tube is described such that the spiral radius with which the glass tube is wound around the axis is substantially constant. In other words, in the embodiment, the shape of the outer appearance of the arc tube is in a cylinder shape having substantially uniform outer diameter.

Incidentally, just as proved in the embodiment, if, in a cross section of the glass tube, the phosphor coating applied is thicker for the holder-side in the axis direction, than for the turning-part direction, it is known to improve the downward illuminance directly below the lamp which is lit over its base (When the lamp is lit in such a way, the axis will coincide with the vertical direction).

Considering the above, in order to efficiently draw out the visible light from the first and second turns of the glass tube from the turning part (i.e. from the supporting member side) to directly below the lamp, it can be considered preferable to make the arc tube in a shape whose outer diameter increases from the turning part towards the holder (i.e. to make the arc tube in a spiral configuration that has larger spiral radius in which the glass tube is wound around the axis, from the turning part towards the holder). In other words, it is considered preferable to make the arc tube as a cone shape, that has larger outer diameter for the holder side. For creating such a shape of arc tube, the mandrel may be formed as a cone shape that widens towards the bottom.

5. Arc Tube

In the embodiment, the arc tube described is to be applied in a compact self-ballasted fluorescent lamp. However, the arc tube that has the structure of having the phosphor coating applied in the above manner, or that is produced using the described production method, may be also applicable to other types of discharge lamps, such as a fluorescent lamp that does not include an electronic ballast therein.

Although the present invention has been fully described by way of examples with references to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A method of producing an arc tube including: a glass tube having a turning part, and being wound around an axis from the turning part to at least one end of the glass tube, so as to form a spiral part; and a phosphor coating provided on an inner surface of the glass tube, the production method comprising:

a step of forming the turning part and the spiral part, by bending a glass tube;

a step of injecting a phosphor-including suspension into the glass tube bent at the forming step;

a step of allowing the suspension to flow from inside the glass tube after the injection step, by keeping the glass tube in an upright state, with the turning part positioned on top; and a step of drying the glass tube after the flow-allowing step, in the upright state.

2. The production method of claim 1, wherein the glass tube is wound around the axis from the turning part to both ends of the glass tube.

3. The production method of claim 1, wherein the suspension is injected into the glass tube with the turning part positioned on top.

4. The production method of claim 3, wherein the injection of the suspension continues until the injected suspension exceeds the turning part.

5. The production method of claim 1, wherein a viscosity of the suspension is in a range of 4.5 cP to 8.0 cP inclusive.

6. The production method of claim 1, wherein an inner diameter of the glass tube is in a range of 5 mm to 9 mm inclusive.

7. A method of producing an arc tube for a lamp comprising the steps of;

providing an elongated glass tube;

heating the glass tube to a softening point;

winding the glass tube about a mandrel to provide a pair of interwound spiral parts extending from a turning point;

blowing a predetermined controlled pressure of gas into the respective spiral parts to maintain a substantially circular cross section to each spiral part as it is wound about a mandrel;

injecting a viscous suspension including phosphor and an adhesive agent into the respective spiral parts to provide a phosphor coating; and drying the phosphor coating wherein at any cross section of the respective spiral parts, the phosphor coating is thicker in a first area than in a second area, the first and second areas facing each other in a direction that is parallel to an axis and that passes through a center of the cross section, the first area being nearer an end of the glass tube than the second area is.

8. The method of claim 7, wherein;

the phosphor coating provided on the first area increases in thickness from the turning part towards the glass-tube end.

9. The method of claim 7, wherein;

the glass tube is wound around the axis from the turning part to both ends of the glass tube.

10. The method of claim 7, wherein;

a mass per unit area of the phosphor coating provided on the second area is in a range of 2 $mg/cm^2$ to 12 $mg/cm^2$ inclusive.

11. The method of claim 7, wherein;

a mass per unit area of the phosphor coating provided on the first area is in a range of 5 $mg/cm^2$ to 30 $mg/cm^2$ inclusive.

12. The method of claim 7, wherein the phosphor coating is a three band phosphor coating.

13. The method of claim 12, wherein the phosphor coating is a mixture of europium-inactivated yttrium oxide, cerium terbium-inactivated lanthanum phosphate and europiums-inactivated barium magnesium aluminate.

14. The method of claim 7, wherein the suspension is injected into the glass tube with the turning part positioned on top.

15. The method of claim 7, wherein the injection of the suspension continues until the injected suspension exceeds the turning part.

16. The method of claim 15, wherein a viscosity of the suspension is in a range of 4.5 cP to 8.0 cP inclusive.

17. The production method of claim 16, wherein an inner diameter of the glass tube is in a range of 5 mm to 9 mm inclusive.

* * * * *